US011030946B1

(12) United States Patent
Chen

(10) Patent No.: US 11,030,946 B1
(45) Date of Patent: Jun. 8, 2021

(54) AMBIENT BRIGHTNESS DETECTION METHOD, ELECTRONIC DEVICE, DETECTION APPARATUS AND STORAGE MEDIUM

(71) Applicant: BEIJING XIAOMI MOBILE SOFTWARE CO., LTD., Beijing (CN)

(72) Inventor: Chaoxi Chen, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 16/916,651

(22) Filed: Jun. 30, 2020

(30) Foreign Application Priority Data

Feb. 12, 2020 (CN) ..... 202010088403.1

(51) Int. Cl.
*G09G 3/3208* (2016.01)

(52) U.S. Cl.
CPC ..... *G09G 3/3208* (2013.01); *G09G 2360/144* (2013.01)

(58) Field of Classification Search
CPC ..... G09G 3/3208; G09G 2360/144
See application file for complete search history.

(56) References Cited

U.S. PATENT DOCUMENTS 7,742,035 B2 * 6/2010 Wu ..... G09G 3/3406 345/102
2007/0146294 A1 * 6/2007 Nurmi ..... G09G 3/3611 345/102
2007/0146301 A1 * 6/2007 Fu ..... G09G 3/3406 345/102
2019/0035352 A1 11/2019 Li
2019/0385572 A1 12/2019 Zhang et al.

FOREIGN PATENT DOCUMENTS

WO WO 2020/025612 A1 2/2020

OTHER PUBLICATIONS

European Search Report dated Dec. 22, 2020 issued in corresponding European application No. 20189566.1.

* cited by examiner

*Primary Examiner* — Stacy Khoo
(74) *Attorney, Agent, or Firm* — Oblon, McClelland, Maier & Neustadt, L.L.P.

(57) ABSTRACT

Aspects of the disclosure provide an ambient brightness detection method, an electronic device, a detection apparatus, and a storage medium. The method can be applied to an electronic device including a display array and a light sensing component that is arranged on a back of the display array. The method can include that a detected brightness is obtained through the light sensing component in a display time slot of a target pixel portion covered by a projection in a plane where the display array is located, and a brightness scene is determined according to present display brightness of the display array. The method can also include that a calculation parameter for calculation of ambient brightness is determined according to the brightness scene, a display refresh rate of the display array, and the detected brightness, and the ambient brightness is determined according to the calculation parameter.

20 Claims, 7 Drawing Sheets

AMBIENT BRIGHTNESS DETECTION METHOD, ELECTRONIC DEVICE, DETECTION APPARATUS AND STORAGE MEDIUM

CROSS-REFERENCE TO RELATED APPLICATION

This application is based upon and claims priority to Chinese Patent Application No. 202010088403.1, filed on Feb. 12, 2020, the entire contents of which are incorporated herein by reference.

TECHNICAL FIELD

The present disclosure relates to the technical field of electronic devices, and particularly, to an ambient brightness detection method, an electronic device, a detection apparatus, and a storage medium.

BACKGROUND

An electronic device typically acquires ambient brightness through a light sensing component and adjusts display brightness of a display array of the electronic device according to the ambient brightness to adapt display brightness of a display screen to the ambient brightness.

A display screen is required to be perforated at all places corresponding to a path for ambient brightness detection of a light sensing component. To reduce perforation in the display screen and increase a screen-to-body ratio of an electronic device, the light sensing component may be arranged below the display screen. In such case, the display screen may impact the ambient brightness detected by the light sensing component.

SUMMARY

According to a first aspect of the present disclosure, a method of ambient brightness detection is provided, which may be applied to an electronic device including a display array and a light sensing component that can be arranged on a back of the display array. The method can include that detected brightness is obtained through the light sensing component in a display time slot of a target pixel portion covered by a projection in a plane where the display array is located, and a brightness scene is determined according to present display brightness of the display array. The method can further include that a calculation parameter for calculation of ambient brightness is determined according to the brightness scene, a display refresh rate of the display array and the detected brightness and the ambient brightness is determined according to the calculation parameter.

According to a second aspect of the present disclosure, an electronic device is provided, which may include a display component, including a display array, and a light sensing component, arranged on a back of the display array. The light sensing component has a projection covering a target pixel portion in the display array in a plane where the display array is located. The light sensing component is configured to obtain detected brightness in a display time slot of the target pixel portion and further configured to determine a brightness scene according to present display brightness of the display array and determine ambient brightness based on a calculation parameter, determined according to the brightness scene, a display refresh rate of the display array and the detected brightness, for calculation of the ambient brightness.

According to a third aspect of the embodiments of the present disclosure, an apparatus for ambient brightness detection is provided, which may include a processor and a memory configured to store instructions executable by the processor. The processor may be configured to execute the instructions to implement the operations in the method of the first aspect of the embodiments of the present disclosure.

According to a fourth aspect of the present disclosure, a non-transitory computer-readable storage medium is provided. Instructions in the storage medium may be executed by a processor of a mobile terminal to cause the mobile terminal to implement the operations in the method of the first aspect of the embodiments of the present disclosure.

It is to be understood that the above general descriptions and detailed descriptions below are only exemplary and explanatory, and not intended to limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Figure 1:
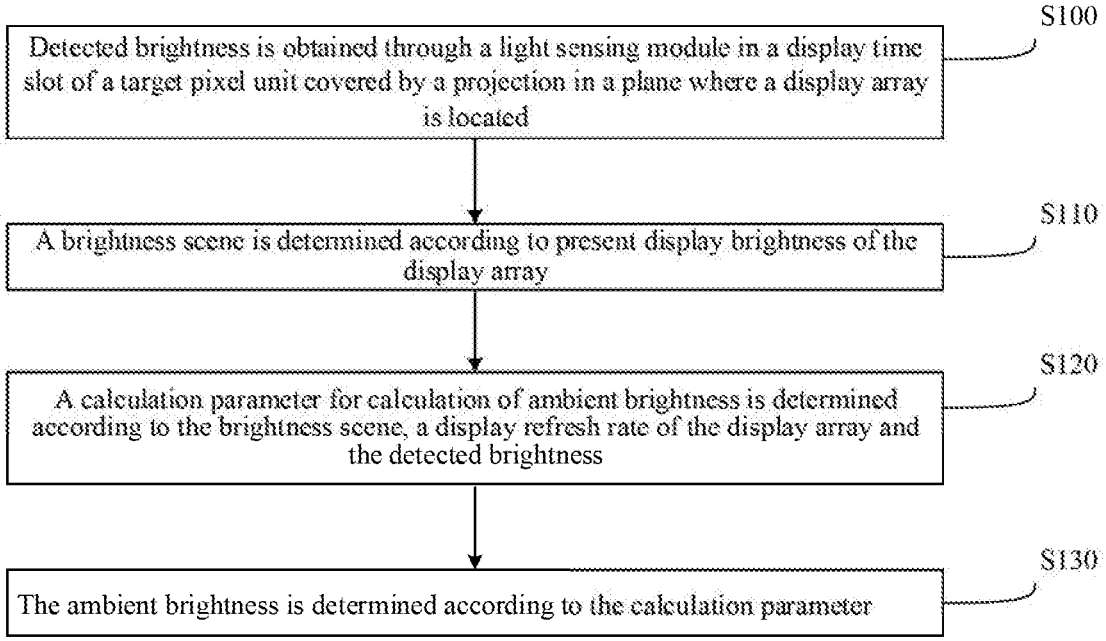
FIG. 1 is a flowchart showing an ambient brightness detection method according to an exemplary embodiment.

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

Along with development of electronic device technologies, more electronic devices with higher screen-to-body ratios are needed for people. For increasing a screen-to-body ratio of an electronic device, it is required to reset functional components occupying a front panel of the electronic device. For example, the functional components may be arranged on a back of a display screen to reduce an occupied area of the front panel of the electronic device and further enlarge an area for arrangement of the display screen on the front panel of the electronic device, namely increasing the screen-to-body ratio of the electronic device. For example, a light sensor for detecting ambient brightness may be arranged below the display screen, and a hole for ambient light reception of the light sensor is not required to be formed in the front panel.

However, when the light sensor is arranged below the display screen, the light sensor can receive two parts of spectral energy. One part is from an external environment and the other part is from light emitted by the display screen in an image display process. That is, when an image is displayed on the display screen, light received by the light sensor below the display screen is a superimposition of ambient light and a part, reflected to the light sensor, of the light emitted by the display screen. Herein, the ambient light is light from a surrounding environment of the electronic device.

It can be understood that, during an actual application, the electronic device is required to provide a reference for an application of the electronic device according to a light intensity value of actual ambient brightness. For example, display brightness of the display screen may be adjusted according to the actual ambient brightness to adapt the display brightness of the display screen to the ambient brightness. Therefore, when the light sensor detects the ambient brightness, the energy of the received light emitted by the display screen is needed to be subtracted from total spectral energy received by the light sensor to achieve accurate detection of the ambient brightness.

Along with gradual increase of demands on better display effects of electronic devices, refresh rates of electronic devices may gradually increase, and electronic devices may be provided with a dynamic refresh rate adjustment function.

In an example, the display screen is made from organic light-emitting diode (OLED) pixels. Luminous content of an OLED pixel is light emitted due to charging of a capacitor controlling the luminous content of the OLED pixel through a transistor (for example, a metal-oxide-semiconductor field effect transistor). When the luminous content of the OLED pixel portion is to be refreshed, the capacitor is required to be discharged. It can be understood that a discharging process of the capacitor cannot be completed immediately but is a process in which power gradually decreases. That is, the OLED pixel may be subject to an on-to-off process in which brightness gradually decreases, and the process requires a period of time.

When the display refresh rate of the electronic device is adjusted, a display time slot of a pixel portion may also change. When the display refresh rate of the electronic device gradually increases, the display time slot of the pixel portion may gradually decrease, and the part, from light emitted by the display screen, of detected brightness obtained by the light sensor may gradually increase.

Therefore, for an electronic device with a relatively high display refresh rate, if detected brightness obtained by a light sensor is directly taken as ambient brightness, there may be a great error, and display brightness adjusted according to the obtained detected brightness may have a great difference from the ambient brightness. Specifically, in such a case, the detected brightness obtained by the light sensor is higher than actual ambient brightness, and after brightness of a display screen is adjusted according to the detected brightness, the display brightness may be higher than the ambient brightness, which may discomfort a user and is unfavorable for a user experience.

FIG. 1 is a flowchart showing an ambient brightness detection method according to an exemplary embodiment. As shown in FIG. 1, the method is applied to an electronic device including a display array and a light sensing component, the light sensing component being arranged on a back of the display array. The method can include the following operations.

In S100, detected brightness can be obtained through the light sensing component in a display time slot of a target pixel portion covered by a projection in a plane where the display array is located.

In 110, a brightness scene is determined according to present display brightness of the display array.

In 120, a calculation parameter for calculation of ambient brightness is determined according to the brightness scene, a display refresh rate of the display array and the detected brightness.

In 130, the ambient brightness is determined according to the calculation parameter.

The display array may include multiple pixel portions. Each pixel portion may include one or more sub-pixels. For example, when a pixel portion includes multiple sub-pixels, the pixel portion may include four sub-pixels. Herein, the four sub-pixels may include two sub-pixels emitting red (R) light, a sub-pixel emitting green (G) light and a sub-pixel emitting blue (B) light. The sub-pixel may include an OLED or a light-emitting diode.

The projection of the light sensing component in the plane where the display array is located has a first overlapping region with the display array. The first overlapping region is a region covered by the projection of the light sensing component in the plane where the display array is located. A pixel portion of the display array in the first overlapping region may be considered as a target pixel portion. The target pixel portion may include one or more abovementioned pixel portions.

A light receiving portion in the light sensing component may have a conical field of view. A light signal entering a range of the conical field of view may be considered as a light signal that can be received by the light sensing component. The range covered by the conical field of view has a second overlapping region with the display array. A pixel portion of the display array in the second overlapping region may be considered as the abovementioned target pixel portion.

During displaying of the display array, each pixel portion has a light emitting period and a display time slot. A pixel portion in the light emitting period may generate a light signal according to a driving signal, namely the pixel portion in the light emitting period emits light. A pixel portion in the display time slot stops generating a light signal, namely the pixel portion in the display time slot temporally does not emit light. Due to persistence of vision, in a display time slot between two adjacent light emitting periods, a visual effect achieved by a light signal generated by a pixel portion in the first light emitting period to the retina of the human eye may stay in the brain of the user in the display time slot, namely the user may consider that the pixel portion keeps emitting light in the display time slot.

The light sensing component, after receiving the light signal, may convert the light signal into an electric signal and may further convert the electric signal into a binary digital value corresponding to each LUX (analog-to-digital converter (ADC) count per lux (CPL)) for storage. The detected brightness may be represented by an electric signal, or may be represented by a binary value corresponding to each LUX converted from the electric signal.

The brightness scene is configured to represent the present display brightness of the display array. Different brightness scenes correspond to different display brightness. Exemplarily, the brightness scene may include a high-light scene and a low-light scene. Display brightness under the high-light scene is higher than display brightness under the low-light scene.

When the present display brightness is low, the display time slot of the pixel portion may be long, and the light sensing component may complete detecting and sampling the ambient brightness to obtain the detected brightness in the display time slot. In such a case, since the display time slot is long, it may be considered that, when the light sensing component obtains the detected brightness, no light is reflected from the screen to the light sensing component, namely the detected brightness obtained by the light sensing component may be directly determined as the calculation parameter for calculation of the ambient brightness.

Along with gradual increase of screen brightness, the display time slot of the pixel may be shorter and shorter, off time of the pixel portion may become shorter and shorter, and on time of the pixel portion may become longer and longer. When the off time of the pixel portion is shorter than minimum integral time of the light sensing component, light received by the light sensing component may not only include ambient light but also include the part, reflected to the light sensing component, of light emitted by the display array. In such a case, the obtained detected brightness is required to be processed to eliminate from the detected brightness the impact of the part, reflected to the light sensing component, of the light emitted by the display array to obtain actual ambient brightness. Therefore, the brightness scene may impact determination of the calculation parameter.

In addition, the electronic device typically adjusts the display brightness of the display array according to the perception of a user to a light intensity. The perception of a human eye to a light intensity does not comply with a basic physical linear growth law but follows a nonlinear stimulated growth law. In such a case, gamma correction is required to be performed on the display brightness of the display array. For different brightness intervals, different correction factors can be adopted for gamma correction of the display array. Therefore, determining the brightness scene is favorable for accurately determining the correction factor for gamma correction and improving a display effect of the display array.

The display fresh rate is configured to represent the amount of image frames displayed in every second in a display process of the display array. It can be understood that, when the display refresh rate is higher, the number of the image frames displayed by the display array in every second is larger.

It is to be pointed out that, for reducing the impact of the light emitted by the display array on ambient brightness detection of the light sensing component, the detected brightness may be obtained in the display time slot in the embodiments of the present disclosure to reduce the impact of the light emitted by the display array on ambient brightness determination of the light sensing component as much as possible.

However, along with gradual increase of the refresh rate, the display time slot of the display array may be gradually shortened, and an error, caused by the light emitted by the display array, between the ambient brightness determined by the light sensing component and the actual ambient brightness may be increased. Therefore, when the display array has a relatively high refresh rate, the light emitted by the display array cannot be ignored for detection of the ambient brightness.

Since a light intensity of the ambient light may be considered as a constant direct current (DC) signal while a light intensity of the light emitted by the display array may be considered as a signal that periodically changes along with the display refresh rate, a light intensity of the part, reflected to the light sensing component, of the light emitted by the display array may also be considered to periodically change along with the display refresh rate.

When the brightness scene is determined, the light intensity of the part, transmitted to the light sensing component, of the light emitted by the display array under the present display brightness may be estimated according to the display refresh rate of the display array, namely a value of impact of the present display brightness of the display array on ambient brightness determination of the light sensing component may be estimated, and the value of impact may further be automatically determined according to change of the display refresh rate to improve the accuracy of ambient brightness detection. The calculation parameter may be represented by an electric signal converted from the light signal received by the light sensing component, or may also be represented by a binary value corresponding to each LUX converted from the electric signal, and the like.

It can be understood that, in a display process of the display array, detected brightness obtained by the light sensing component may include brightness of light emitted by the display array, resulting in a great error between ambient brightness determined by the light sensing component and actual ambient brightness.

According to the embodiments of the present disclosure, the detected brightness may be obtained through the light sensing component in the display time slot of the target pixel portion covered by the projection in the plane where the display array is located, which reduces the impact of light emitted by the target pixel portion on the detected brightness obtained by the light sensing component and is favorable for improving the accuracy of the ambient brightness determined by the light sensing component.

In addition, according to the embodiments of the present disclosure, the brightness scene may be determined according to the present display brightness of the display array, the calculation parameter for calculation of the ambient brightness may be determined according to the brightness scene and the detected brightness, and the ambient brightness may be determined according to the calculation parameter. Corresponding calculation parameters may be automatically determined according to differences of brightness scenes of the display array to further determine the ambient brightness, which is favorable for further improving the accuracy of the determined ambient brightness, provides an accurate basis for adjusting display brightness of the electronic device and improves the user experience.

Moreover, according to the technical solution provided in the embodiments of the present disclosure, the calculation parameter configured to determine the ambient brightness may be automatically changed according to a change of the display refresh rate of the electronic device with a display refresh rate of the display array being dynamically updated, so that the accuracy of ambient brightness detection is improved under the condition that the display refresh rate is dynamically updated.

In some embodiments, S110 may include that: when the present display brightness is greater than a brightness threshold, it is determined that the brightness scene is a high-light scene.

In some embodiments, S110 may include that: when the present display brightness is less than or equal to the brightness threshold, it is determined that the brightness scene is a low-light scene.

The present display brightness is configured to represent display brightness of the display array at a present moment. During an actual application, the present display brightness may be represented by a preset value. Specifically, the display brightness may be represented by an integer from 0 to 2,047. When the present display brightness is 0, the display array may be considered in a screen-off state. When the present display brightness is 2,047, the display array may be considered in a maximum display brightness state.

Exemplarily, the high-light scene and the low-light scene may be distinguished by setting of a brightness threshold.

In an example, the display brightness may be represented by a value ranging from 0 to 2,047, and the brightness threshold may be an integer ranging from 0 to 2,047. Exemplarily, the brightness threshold may be set according to actual conditions of different electronic devices. For example, the brightness threshold may be 300, 400 or 1,000. In an example that the brightness threshold is 300, when the present display brightness is greater than 300, it can be determined that the brightness scene of the display array is the high-light scene; and when the present display brightness is less than 300, it can be determined that the brightness scene of the display array is the low-light scene.

In the embodiments of the present disclosure, the brightness scene may be determined by setting a brightness threshold and comparing present display brightness with the brightness threshold. This manner is simple and highly compatible with the related art.

Further, S110 may include that, when a modulation manner for a driving signal corresponding to the present display brightness is a DC modulation manner, it is determined that the brightness scene is the high-light scene. Additionally, S110 may include that, when the modulation manner for the driving signal corresponding to the present display brightness is a pulse amplitude modulation (PAM) manner or a pulse width modulation (PWM) manner, it is determined that the brightness scene is the low-light scene.

In an example, different brightness scenes may correspond to different modulation manners for a driving signal controlling the display array to emit light. Brightness modulation of the display array is a hybrid modulation result. In different modulation manners, display refresh manners of the display array may be different. Therefore, calculation parameters configured to calculate ambient brightness under different brightness scenes may be different. It is to be pointed out that, when calculation parameters are different, determined ambient brightness is different.

Further, under the low-light scene, PAM or PWM may be executed and, under the high-light scene, the DC modulation manner may be executed. Or, in a low-brightness region, PAM may be executed; in a medium-brightness region, PWM may be executed; and in a high-brightness region, a hybrid PAM-PWM manner may be executed. It is to be pointed out that display brightness of the low-brightness region is lower than display brightness of the medium-brightness region. When the present display brightness is in the low-brightness region or the medium-brightness region, the brightness scene is the low-light scene and, when the present display brightness is in the high-brightness region, the brightness scene is the high-light scene.

In the embodiments of the present disclosure, the brightness scene may be determined through a modulation manner for a driving signal corresponding to present display brightness. The manner is simple and highly operable.

In some embodiments, S120 may further include that, when the brightness scene is the low-light scene, the detected brightness is determined as the calculation parameter for calculation of the ambient brightness. In the low-light scene, the modulation manner for a driving signal of the display array may be PWM. Since each pixel portion may periodically emit light and stop emitting light alternately in a refresh process of a frame of image, the light sensing component may obtain the detected brightness in the display time slot of the target pixel portion. In such a case, it may be considered that determination of the ambient brightness may not be impacted by the present display brightness of the display array in the display time slot of the target pixel portion covered by the light sensing component. Therefore, the detected brightness may directly be determined as the calculation parameter for calculation of the ambient brightness.

In some embodiments, S130 may include that: the ambient brightness is determined according to the calculation parameter and a preset attenuation coefficient.

For example, an attenuation/gain coefficient vector is $K_n$, and a method for calculating and determining the ambient brightness Lux according to the calculation parameter may be as follows:

$$Lux = Lux' * K = \begin{vmatrix} Lux'_{1m} \\ M \\ Lux'_{nm} \end{vmatrix} * | K_1 \quad L \quad K_n | =$$

$$\begin{vmatrix} K_1 * (K_{11} * \text{Channel}_1 + L + K_{1m} * \text{Channel}_m) & L & K_n * (K_{n1} * \text{Channel}_{n1} + L + K_{nm} * \text{Channel}_{nm}) \end{vmatrix}$$

Example 1

In the light sensing component, two channels configured to convert an analog parameter into a digital parameter may be designed according to different IR components in received light signals. Specifically, the light sensing component may include a first channel and a second channel. The first channel is configured to receive a light signal of a visible light band of 380 nm to 780 nm and record a digital parameter converted from the received light signal as a, this band being a spectral band that a visual cell of a human eye can respond to. The second channel is configured to receive a light signal of an IR band and record a digital parameter converted from the received light signal as b.

When the ambient brightness is detected under the low-light scene, an algorithm formula for calculation of the ambient brightness may be judged according to a ratio of the digital parameter b to the digital parameter a.

There is made such a hypothesis that, under different light source conditions, three algorithm formulae may be adopted to calculate the ambient brightness according to the calculation parameter under the low-light scene, expressed as $Lux_1$, $Lux_2$ and $Lux_3$ respectively. Herein, the three algorithm formulae may represent calculation formulae for the ambient brightness under different spectral components respectively. Then, the ambient brightness determined according to the calculation parameter may be expressed as $Lux=\max(Lux_1,Lux_2,Lux_3)$ or $Lux=\min(Lux_1,Lux_2,Lux_3)$. Herein, Lux is adopted to represent the ambient brightness determined by the light sensing component.

For example, the light sensing component may include two channels, i.e., the first channel and the second channel. There is made such a hypothesis that:

$$Lux_1 = \frac{(\text{Channel}_0 - CoB * \text{Channel}_1)}{CPL} = \frac{\text{Channel}_0}{CPL} - \frac{CoB * \text{Channel}_1}{CPL}, \quad (1)$$

$$Lux_2 = \frac{CoC * \text{Channel}_0 - CoD * \text{Channel}_1}{CPL}, \text{ and} \quad (2)$$

$$Lux_3 = \frac{CoE * \text{Channel}_0 - CoF * \text{Channel}_1}{CPL}, \quad (3)$$

where CPL (ADC CLP) represents a binary value converted by the electronic device from illumination of the received light signal, i.e., a binary value corresponding to each LUX, $\text{Channel}_0$ represents a binary value (ADC count) obtained by the first channel by performing analog-to-digital conversion according to a received light signal in the range of 380 nm to 78 nm, $\text{Channel}_1$ represents a binary value obtained by the second channel by performing analog-to-digital conversion according to a received light signal in the IR range, and CoB, CoC, CoD, CoE and CoF represent different first-type calculation coefficients.

It can be understood that the binary value obtained by the first channel may be positively correlated with a light intensity of the received light signal in the range of 380 nm to 780 nm and the binary value obtained by the second channel may be positively correlated with a light intensity of the received light signal in the IR range.

$$\text{If } K_0 = \frac{1}{CPL} \text{ and } K_1 = \frac{CoB}{CPL}, \text{ then:}$$

$$Lux_1 = K_0 * \text{Channel}_0 - K_1 * \text{Channel}_1, \quad (4)$$

$$Lux_2 = K_2 * \text{Channel}_0 - K_3 * \text{Channel}_1, \quad (5)$$

$$Lux_3 = K_4 * \text{Channel}_0 - K_5 * \text{Channel}_1, \text{ and} \quad (6)$$

$$\begin{vmatrix} CoC = \frac{K_2}{K_0} & CoD = \frac{K_3}{K_0} \\ CoE = \frac{K_4}{K_0} & CoF = \frac{K_5}{K_0} \end{vmatrix} \quad (7)$$

$K_0$, $K_1$, $K_2$, $K_3$, $K_4$ and $K_5$ represent different second-type calculation coefficients respectively.

The formulae (4), (5) and (6) may be combined to calculate $K_0$, $K_1$, $K_2$, $K_3$, $K_4$ and $K_5$ represented by $Lux_1$, $Lux_2$, $Lux_3$, $\text{Channel}_0$ and $\text{Channel}_1$, Furthermore, CoB, CoC, CoD, CoE and CoF may be obtained according to $K_0$, $K_1$, $K_2$, $K_3$, $K_4$ and $K_5$.

When the light sensing component includes two channels, a channel matrix may be expressed as channel=[$\text{Channel}_0$, $\text{Channel}_1$], the channel matrix representing the binary values obtained by performing analog-to-digital conversion on light signals detected by each channel.

Exemplarily, an ambient brightness data matrix Lux of different light sources may be detected through an illuminometer, and the number of columns of the ambient brightness data matrix Lux may be determined according to the light sources required to be fitted and the distinguishing accuracy. Since the channel matrix channel may be obtained according to an analog-to-digital converter, a coefficient matrix K may be acquired according to a formula channel*K=Lux, the first-type calculation coefficients CoB, CoC, CoD, CoE and CoF may further be acquired, and CPL may also be acquired.

It may be set that light transmittance of the display array of the electronic device is T, a light attenuation rate of the display array of the electronic device is TA (Touch panel attenuation) and a device factor of the electronic device is DC (Device Co-efficiency). Then:

$$TA = 1/T, \quad (8)$$

$$CPL = \frac{(\text{Integral_time} * \text{Integral_gain})}{TAC}, \quad (9)$$

$$TAC = \frac{(\text{Integral_time} * \text{Integral_gain})}{CPL}, \quad (10)$$

$$TAC = TA * \text{DC}, \text{ and} \quad (11)$$

$$\text{DC} = \frac{TAC}{TA}, \quad (12)$$

where CPL may represent a binary value that can be converted from illumination of 1 LUX under an integral time and an integral gain, Integral_time represents an integral time which is set in the light sensing component, and Integral_gain represents an integral gain which is set in the light sensing component. After CPL is acquired, TAC, DC and TA may be acquired.

No light in the IR band but light in the range of the visible light band (380 nm to 780 nm) is visible to a human eye. Therefore, when proportions of IR components in light signals emitted by light sources in an environment are different and when the light sensing component takes the light sources with different IR components as the same light source for calculation of ambient brightness, there may be a great error between the ambient brightness determined by the light sensing component and actual ambient brightness.

Figure 2:
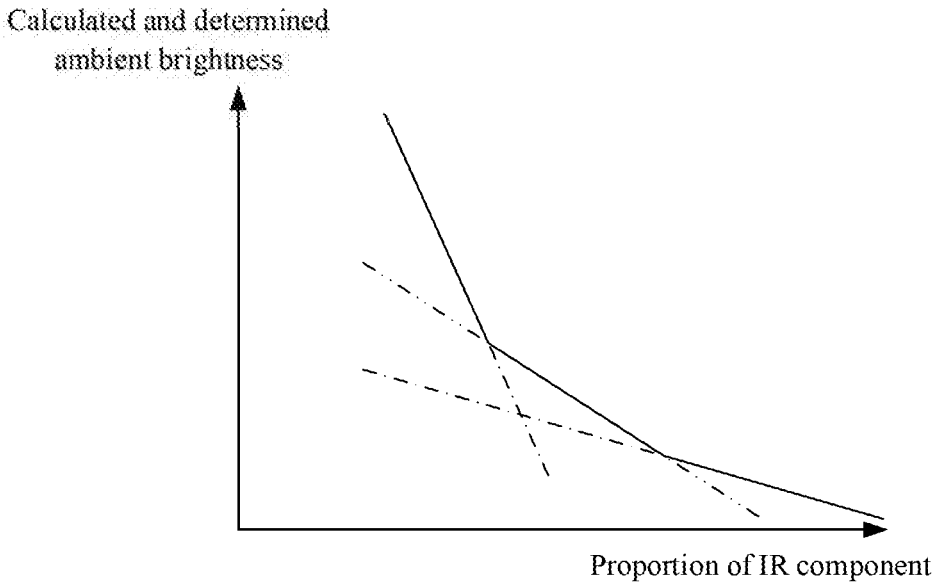
FIG. 2 is a relationship curve between a proportion of an infrared (IR) component and calculated and determined ambient brightness according to an exemplary embodiment.

FIG. 2 shows a relationship curve between ambient brightness calculated for light sources with different proportions of IR components according to the algorithms $Lux_1$, $Lux_2$ and $Lux_3$ respectively and proportions of the IR components according to an exemplary embodiment. It can be understood that the solid line part of the function curve in the coordinate system in FIG. 2 represents a function curve of $Lux=\max(Lux_1,Lux_2\ Lux_3)$ In the embodiments of the present disclosure, light sources may be distinguished according to differences of IR components, and ambient brightness under the light sources may be determined through different first-type calculation coefficients or different second-type calculation coefficients respectively.

In combination with the formulae (4), (5) and (6), for determining the coefficient matrix K of the light sensing component under different types of light sources, the binary values, corresponding to the illumination of each LUX, of the first and second channels of the light sensing component may be acquired under different light sources, the integral time Integral_time and the integral gain Integral_gain may be obtained from settings of the light sensing component, and the corresponding ambient brightness $Lux_1$, $Lux_2$ and $Lux_3$ under different light source conditions may be obtained by illuminometer and may be substituted into the formulae (4), (5) and (6) to calculate the coefficient matrix K.

Specifically, the binary values acquired by the light sensing component under different light sources and obtained by the first channel and the second channel by performing analog-to-digital conversion according to the received light signals may be obtained. At least six groups of values that do not have a linear relationship under different light sources may be substituted into the formulae (4), (5) and (6) to obtain the coefficient matrix K.

Herein, different light sources may include a CWF light source simulating shop light, an A light source simulating a spot lamp, a D50 light source simulating the sunlight, a U30 light source simulating another type of shop light, a TL84 light source simulating another type of shop light and an H light source simulating the horizon, etc.

In addition, when the ambient brightness determined by the light sensing component is fitted, for ensuring that a fitted parameter satisfies consistency of different electronic devices, at least two different electronic devices may be adopted for fitting to improve the accuracy of the coefficient matrix K finally obtained by fitting and reduce a difference value between the ambient brightness determined through the fitted matrix parameter and the ambient brightness detected through the illuminometer.

It is assumed that P groups of data are acquired for each light source. The P groups of data may be traversed according to all combinations to obtain $C_P^6$ coefficient matrices. Each calculated coefficient matrix may be substituted into a calculation algorithm for the P groups of data to output an error between the determined ambient brightness and the ambient brightness detected by the illuminometer, and the coefficient matrix with the smallest error may be determined as the determined coefficient matrix K. In such a case, the fitting effect is best. That is, the coefficient matrix with the smallest error may be determined as the coefficient matrix K applied to the algorithm for determining the ambient brightness according to a detection parameter, the error between the ambient brightness calculated according to the algorithm and the actual ambient brightness may be smallest, and the accuracy of ambient brightness detection may be high.

Specifically, it is assumed that a light intensity value output by the illuminometer for each group of acquired data is expressed as $Lux_q$, the ambient brightness calculated by substituting each calculated coefficient matrix K into the acquired binary values converted from intensities of the received light signals by the first channel and second channel is $Lux'_q$ and a root mean square value is $Stdev_q$, then $$Stdev_q = \sqrt{\frac{\sum_{q=1}^{C_P^6} (Lux_q - Lux'_q)^2}{P}} \tag{13}$$

For each calculated coefficient matrix K, there is a root mean square value, and then:

$$Sdev_{C_P^6} = \{Sdev_1\ Stdev_2\ L\ Srdev_T\} \tag{14}$$

The $Sdev_{C_P^6}$ array may be traversed to find a minimum value $Srdev_{min}$ the $Sdev_{C_P^6}$ array. When the ambient brightness is calculated and determined through a coefficient matrix corresponding to the minimum root mean square value, the error between the calculated ambient brightness and the actual ambient brightness may be smallest.

According to the embodiments of the present disclosure, the coefficient matrix K corresponding to the minimum root mean square value may be determined by multiple experiments, and the determined coefficient matrix K may be substituted into the formulae (4), (5) and (6) to calculate the ambient brightness, so that the accuracy of ambient brightness detection is improved, and the user experience is improved.

Furthermore, when detection spectrums are more finely divided, the light sensing component may include m (m is a natural number) channels, and then:

$$channel = [Channel_1\ Channel_2 L\ Channel_m] \tag{15}$$

For the first channel to the mth channel, $Channel_{z-1}$ represents a binary value obtained by performing analog-to-digital conversion on a light signal detected by the z th channel, z being greater than or equal to 1 and z being smaller than or equal to m.

Correspondingly, the coefficient matrix K formed by the second-type calculation coefficients may also include multiple columns. During an actual application, the number of columns of the coefficient matrix K may be set according to the number of light sources required to be distinguished for the algorithm. When types of the light sources are distinguished more specifically, the number of columns of the coefficient matrix K can be larger. It is to be pointed out that different light sources may include different IR components. When the number of channels of the light sensing component is larger, the number of columns of the coefficient matrix K can be larger. For example, the light sensing component may include m channels and n different light source types may be distinguished. The coefficient matrix may be represented as $$K = \begin{vmatrix} K_{11} & L & K_{1m} \\ M & O & M \\ K_{n1} & L & K_{nm} \end{vmatrix},$$

where $K_{11}$ to $K_{nm}$ (n=1, 2, 3 . . . and m=1, 2, 3 . . . ) are coefficients obtained through a process similar to the fitting process in example 1.

In the low-light scene, the light sensing component may convert the binary value (ADC count) obtained by analog-to-digital conversion into the light intensity value Lux', which may be represented as follows:

$$Lux' = \begin{vmatrix} Lux'_{1m} \\ M \\ Lux'_{nm} \end{vmatrix} = \begin{vmatrix} K_{11} * Channel_{11} + L + K_{1m} * Channel_{1m} \\ M \\ K_{n1} * Channel_{n1} + L + K_{nm} * Channel_{nm} \end{vmatrix} \tag{16}$$

where $Channel_{11}$ to $Channel_{nm}$ represent binary values corresponding to light intensities detected by each channel of the light sensing component, $K_{11}$ to $K_{nm}$ (n=1, 2, 3 . . . and m=1, 2, 3 . . . ) are coefficients obtained by fitting, n represents a light source type that can be distinguished in the light sensing component in an external environment, n different light source types may correspond to different coefficients $K_{nm}$ calculated by light intensity fitting, and m represents the number of channels of the light sensing component. For example, $\text{Channel}_{nm}$ represents a binary value corresponding to light intensity detected by the m th channel under the condition of the nth light source.

It is to be pointed out that, for the same channel of the light sensing component, under the condition that present display brightness is the same, values of impact of different types of light sources on ambient brightness determination of the light sensing component may be different. Under the condition that the present display brightness is different, values of impact of different types of light sources on ambient brightness determination of different channels of the light sensing component may also be different.

When the attenuation/gain coefficient vector in the spectral fitting process is $K_n$, the method for calculating and determining the ambient brightness Lux according to the calculation parameter may be as follows:

$$Lux = Lux' * K = \begin{vmatrix} Lux'_{1m} \\ M \\ Lux'_{nm} \end{vmatrix} * | K_1 \quad L \quad K_n | = \begin{vmatrix} K_1 * (K_{11} * \text{Channel}_1 + L + K_{1m} * \text{Channel}_m) & L & K_n * (K_{n1} * \text{Channel}_{n1} + L + K_{nm} * \text{Channel}_{nm}) \end{vmatrix} \tag{17}$$

$\text{Channel}_{11}$ to $\text{Channel}_{nm}$ represent calculation parameters under the low-light scene.

It is to be pointed out that, when ambient light of an external environment has different light source types, mutual impact between the light emitted by the pixel portion and the light emitted by the light source in the external environment may be different, so that the coefficients $K_{11}$ to $K_{nm}$ (n=1, 2, 3 . . . and m=1, 2, 3 . . . ) obtained by fitting may be different.

In some embodiments, S120 may include that, when the brightness scene is the high-light scene, a value of impact of the present display brightness on ambient brightness determination of the light sensing component is estimated based on a preset model according to the detected brightness, the preset model being obtained by training detected brightness samples under a preset brightness scene. Further, the calculation parameter for calculation of the ambient brightness is determined according to a difference value between the detected brightness and the value of impact.

Exemplarily, under the high-light scene, the DC modulation manner may be adopted for the display array of the electronic device. In the DC modulation manner, display power of the display array may be changed to change the display brightness. When the display power is higher, the display brightness can be higher. In a refresh process of each frame of image, after each pixel portion is refreshed, the pixel portion may be kept in a normally on state until a next frame of image is started to be refreshed. When the next frame of image is started to be refreshed, the pixel portions may be sequentially turned off to refresh display content and then turned on.

It is to be pointed out that, under the high-light scene, the detected brightness obtained by the light sensing component may include the part, reflected to the light sensing component, of the light emitted by the display array. Since the ambient light may be approximated as a DC signal but the spectral energy of the light emitted by the display array changes based on the display refresh rate, when the ambient brightness is detected, it is needed to estimate the value of impact of the present display brightness of the display array on ambient brightness determination of the light sensing component, determine the calculation parameter for calculation of the ambient brightness according to the difference value between the detected brightness and the value of impact and further determine the ambient brightness according to the determined calculation parameter to improve the accuracy of ambient brightness detection.

Exemplarily, when an image is refreshed by the display array, the light sensing component may periodically acquire detected brightness and execute a fast fourier transform (FFT) operation on a numerical value of the obtained detected brightness to determine a frequency-domain amplitude of the display refresh rate to estimate a value of impact of present display brightness of the display array on ambient brightness determination of the light sensing component.

Exemplarily, the frequency-domain amplitude of the display refresh rate may also be determined through a Goertzel algorithm. The amplitude represents the value of impact of the present display brightness on ambient brightness determination of the light sensing component.

Compared with determining the frequency-domain amplitude of the display refresh rate by FFT, determining the frequency-domain amplitude of the display refresh rate by the Goertzel algorithm in the embodiment of the present disclosure may reduce the calculated amount and reduce occupied computing resources of a processing component of the electronic device.

It is to be pointed out that, since a formula for the Goertzel algorithm includes an indeterminate coefficient correlated with the display refresh rate, when the frequency-domain amplitude of the display refresh rate is determined by the Goertzel algorithm under the high-light scene, it is needed to determine the indeterminate coefficient in the called Goertzel algorithm according to the acquired display refresh rate and further calculate frequency-domain amplitudes of fundamental frequencies or fundamental frequencies plus double frequencies of different display refresh rates, namely determining the value of impact of the present display brightness on ambient brightness determination of the light sensing component.

For determining the value of impact of the present display brightness of the display array on ambient brightness determination of the light sensing component in the high-light environment, a prediction model may be obtained by experiments. The preset model is configured to determine the value of impact of present display brightness of the display array on ambient brightness determination of the light sensing component.

Specifically, in a black light-absorbing camera obscura environment, it may be set that an overlapping region between the display array and an orthographic projection of the light sensing component in the plane where the display array covers i pixel portions, each pixel portion including three sub-pixels R, G and B and each sub-pixel having 256 brightness levels. Each pixel portion has $2^{24}$ brightness levels, and the t pixel portions have $2^{24*t}$ brightness levels. It can be understood that, when the brightness level of each pixel portion is different, display content of the display array may be different and the brightness scene may be also different.

Part of pixel portions in the t pixel portions may be selected as samples for training, and then a large number of scatter diagrams between display refresh rates of the display array in a frequency domain and values of impact of the present display brightness of the display array on ambient brightness determination of the light sensing component under the conditions of the display contents and the brightness levels may be obtained. For example, display refresh rates of the display array and values of impact of the present display brightness of the display array on ambient brightness determination of the display array under $2^{24*t}$ brightness levels of the t pixel portions may be acquired. When the light sensing component includes m channels, m scatter diagrams may be obtained.

Exemplarily, the preset brightness scene may represent a specific brightness scene in a training process.

It can be understood that a sample of detected brightness refers to detected brightness configured to be trained in the training process of the preset model to obtain a parameter coefficient. The sample of detected brightness may be obtained through an integrated circuit (IC) collection component with a light collection function.

Data in the scatter diagrams may be fitted, and a function relationship between a frequency-domain amplitude, obtained by FFT, of the display refresh rate and a value of impact may be acquired by iterative solution according to a principle that a calculated fitted parameter causes a root mean square of an error between the calculated value of impact predicted by a function model and an actual value of impact to be minimum. Namely, a function relationship between the value of impact and the frequency-domain amplitude of the display refresh rate can be obtained. The function relationship is the preset model.

When the ambient brightness is detected, the light sensing component may acquire data reflecting the detected brightness after delay time starting from sending of a frame synchronization signal of the display array to the light sensing component. For example, in a pulse signal period of driving the target pixel portion for displaying, four pieces of data representing the detected brightness, or six pieces of data representing the detected brightness or eight pieces of data representing the detected brightness may be acquired through a pulse and phase-locked loop circuit in the light sensing component.

After the light sensing component obtains the detected brightness, a FFT operation may be executed on the detected brightness to obtain the frequency-domain amplitude of the display refresh rate, and the amplitude may be substituted into the prediction model for calculation to estimate the value of impact of the present display brightness of the display array on ambient brightness determination of the light sensing component. Then, the value of impact estimated by the prediction model may be subtracted from the detected brightness obtained by each channel of the light sensing component to determine the calculation parameter configured to calculate the ambient brightness. Finally, the calculation parameter of each channel may be substituted into a formula (for example, the formula (17)) for calculation of the ambient brightness to determine the ambient brightness Lux.

In the display refresh process of each frame of image, after the detected brightness is obtained, the ADC may be turned off, and data determined according to the detected brightness and representing the ambient brightness may be stored in a first in first out (FIFO) storage portion of the light sensing component, or the data reflecting the ambient brightness may be sent to the processing component of the electronic device through an inter-integrated circuit (I2C) bus, to enable the electronic device to determine present ambient brightness. After the data is completely acquired, sending of an interrupt signal may be stopped, and the ADC may be turned on to start next integration.

In the refresh process of each frame of image, after the light sensing component completes acquiring the detected brightness and determining the ambient brightness, a signal may be sent to the processing component of the electronic device through the I2C bus or an interrupt pin (INT PIN) to notify the processing component to acquire the data representing the ambient brightness.

Example 2

In the example, the pixel portions in the display arrays may be OLED pixel portions, the DC modulation manner may be adopted under the high-light scene and the light sensing component may include four channels configured to obtain the detected brightness, the four channels being a visible light channel (C channel), a red channel (R channel), a green channel (G channel) and a blue channel (B channel). Herein, the visible light channel is configured to detect a light signal in a band range of 380 nm to 780 nm, the R channel is configured to detect a light signal in a band range of 600 nm to 780 nm, the G channel is configured to detect a light signal in a band range of 490 nm to 600 nm, and the B channel is configured to detect a light signal in a band range of 380 nm to 490 nm.

Figure 3:
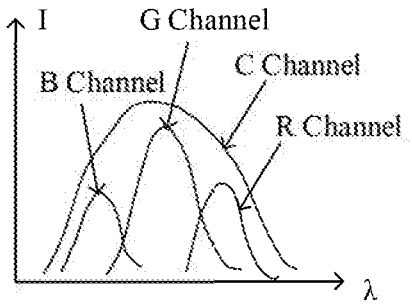
FIG. 3 is a schematic diagram of a response function of each channel of a light sensing component according to an exemplary embodiment.
Figure 4:
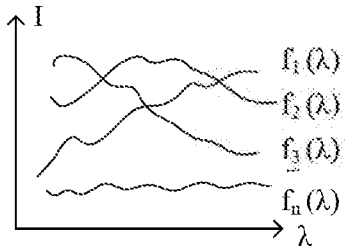
FIG. 4 is a diagram of spectral functions of multiple light sources according to an exemplary embodiment.

FIG. 3 shows channel response functions $F_i(\lambda)$ of the four channels for light in different wavelength ($\lambda$) ranges, where i=C, R, G or B, and i represent different channels. FIG. 4 shows spectral functions $F_j(\lambda)$ of n different light sources, where n is a natural number, different values of j represent different light sources, j=1, 2, 3 . . . n, and I represents the light intensity.

Figure 5:
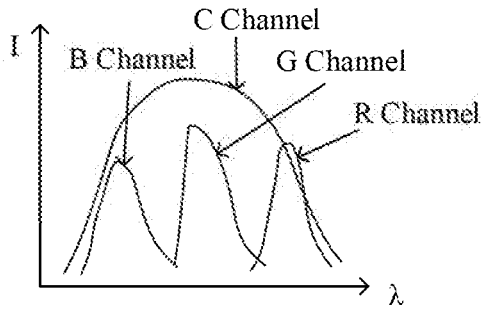
FIG. 5 is a spectral function diagram of a light sensing component according to an exemplary embodiment.
Figure 6:
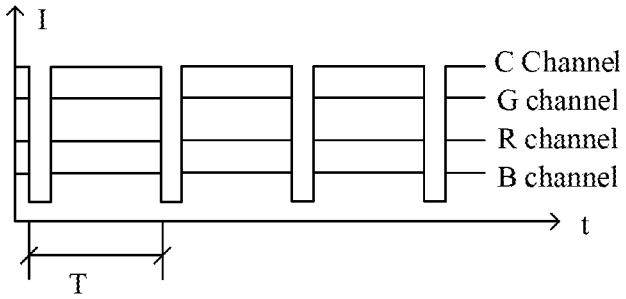
FIG. 6 is a time-domain function diagram of present display brightness of a display array according to an exemplary embodiment.

A convolution operation may be performed on the channel response functions of the four channels in FIG. 3 and the spectral functions of the n light sources in FIG. 4 respectively to obtain spectral functions $R_{ij}(\Delta)=F_i(\lambda)\otimes F_j(\lambda)$ as shown in FIG. 5. FIG. 6 shows a time-domain characteristic curve $OLED_i(t)$ of each channel of the light sensing component for present display brightness of the display array.

Figure 7:
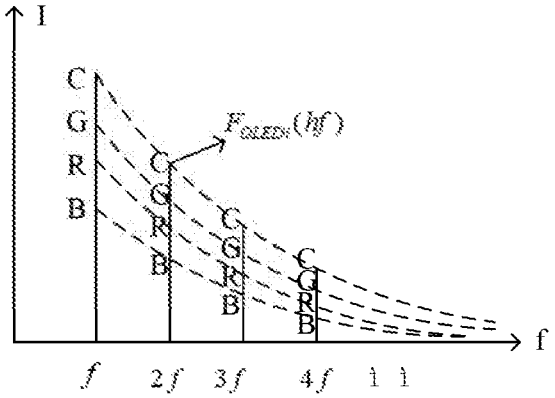
FIG. 7 is a frequency-domain function diagram of present display brightness of a display array according to an exemplary embodiment.

FIG. 7 shows a frequency-domain relational function $FOLED_i(hf)$, detected by each channel of the light sensing component, between present display brightness of the display array and a display refresh rate in the DC modulation manner. When the fundamental frequency of the display refresh rate is $f$, the double frequency of the display refresh rate may be $hf$, h being a natural number. For the DC modulation manner, the display refresh rate may include 60 hz, 90 hz or 120 hz, etc.

It is to be pointed out that the amplitude of the display refresh rate under the present display brightness of the display array may be calculated according to the Goertzel algorithm, namely $F_{OLEDi}(hf)=\text{Goertzel}_i(X_i)$, $X_i=OLED_i(t)$.

When a function model relationship between an amplitude obtained by performing FFT on a display refresh rate of the display array and a value of impact of present display brightness of the display array on ambient brightness determination of the light sensing component is $f(x)=Ax^n+Bx^{n-1}+Cx^{n-2}+L+Zx^0$, A, B, CZ being unknown coefficients and n being equal to 2, for the light sensing component including the four channels, there may be functions as below:

$$f_i(x)=A_ix^n+B_ix^{n-1}+C_i \quad (18), \text{ and}$$

$$x=\sum_{h=1}^{n} F_{OLED_i}(hf),\ n=1, 2, 3, \ldots \quad (19)$$

It is assumed that the detected brightness obtained by the light sensor is $\text{Register}_i(x)$ and the calculation parameter is $\text{Ambient}_i(x)$ then:

$$\text{Ambient}_i(x)=\text{Register}_i(x)-f_i(x) \quad (20)$$

The formula (20) may be substituted into the formula (17) to obtain the ambient brightness $Lux=K*Amblent_i(x)$ under the high-light scene.

In some embodiments, a detection frequency at which the light sensing component obtains the detected brightness may be higher than double of the display refresh rate of the display array.

Exemplarily, the pixel portions may be OLED pixels. Under the low-light scene, an OLED pixel turning-on/off mechanism may control data on a capacitor of the display pixel to turn on or turn off the capacitor through a thin film transistor (TFT) switch when the OLED emits light, so that the light sensing component may detect the ambient light in the off time of the light-emitting diode and perform photoelectric conversion on the received light signal to generate a light current.

The generated light current may be transmitted to a capacitor at a preceding stage of the ADC to charge the capacitor. When a voltage applied to the capacitor reaches a preset charging voltage, the TFT may be turned off, meanwhile, the ADC may start sampling to generate a binary ADC count, and the generated binary ADC count may be configured to determine the ambient brightness as the calculation parameter.

Along with gradual increase of brightness of the display array, in the display refresh process of each frame of image, the off time of the pixel portion may be gradually shortened, and the on time may be gradually prolonged. Herein, the off time of the pixel portion may be considered as the display time slot of the pixel portion. It is to be pointed out that time when the light sensing component obtains the detected brightness may be shorter than half of the display time slot.

When the off time of the pixel portion is shortened to the minimum integral time of the light sensing component, the impact of the present display brightness of the display array on ambient brightness determination of the light sensing component cannot be ignored. In such a case, the obtained detected brightness cannot be determined as the calculation parameter for the ambient brightness, and instead, it is required to estimate the value of impact of the present display brightness on ambient brightness determination of the light sensing component and determine the calculation parameter for calculation of the ambient brightness according to the difference value between the detected brightness and the value of impact.

Then, a frame synchronization signal of the display array may be sent to the light sensing component. When displaying of the display array is refreshed to the target pixel portion after delay of a period of time based on the frame synchronization signal received by the light sensing component, the light sensing component may be powered on and start integral sampling, namely starting obtaining detected brightness. The value of the obtained detected brightness may be used for a light intensity value of external ambient brightness.

In the embodiments of the present disclosure, the detection frequency at which the light sensing component obtains the detected brightness may be set to be higher than double of the display refresh rate of the display array, so that the amount of the detected brightness obtained by the light sensing component may be increased, and the accuracy of the ambient brightness determined by the light sensing component may further be improved.

In some embodiments, the method may further include that the display time slot of the target pixel portion can be determined according to a frame synchronization signal of the display array and acquired delay time, the delay time being predetermined according to a position relationship between the target pixel portion and a first pixel portion of the display array. For example, a frame synchronization signal may be generated through a driver IC of the display array. For example, a vertical Sync (VYSNC) signal generated after the display array completes scanning data of a frame of image may be the frame synchronization signal. Herein, the VYSNC signal represents that refreshing of a previous frame of image is completed and refreshing of a next frame of image is started.

Exemplarily, the display time slot of the target pixel portion may be determined through the light sensing component according to the frame synchronization signal of the display array and the acquired delay time. Therefore, delaying may be performed based on the structure of the light sensing component after the frame synchronization signal is received, and the detected brightness may be started to be obtained after the delay time. The manner is simple.

Alternatively, the display time slot of the target pixel portion may also be determined through the processing component in the electronic device according to the frame synchronization signal of the display array and the acquired delay time. Herein, the processing component may include a central processing portion (CPU), an application program (AP) or a micro-controller portion (MCU), etc.

In the embodiments of the present disclosure, the display time slot may be determined through the processing component in the electronic device to control the light sensing component in a software control manner to obtain the detected brightness in the display time slot of the target pixel portion. High compatibility with the conventional art is achieved, and the manner is simple.

In some embodiments, the delay time may have a predetermined number of delay time lengths. The method may further include that the number of delay time lengths is counted, and a first triggering signal is output when counting is ended, and S100 may include that the detected brightness is obtained through the light sensing component in the display time slot of the target pixel portion covered by the projection in the plane where the display array is located based on triggering of the first triggering signal.

In an example, an AP of the electronic device may receive a frame synchronization signal. The AP may internally include a hardware circuit with a counting function or include software with a counting function. When the AP receives the frame synchronization signal, the counting function may be started for counting, and a counting-up or counting-down manner may be adopted. For example, when the counting-up manner is adopted, counting is started from 0, and counting is ended till a predetermined number is reached.

When counting is ended, the AP may output a first triggering signal to trigger the light sensing component to obtain detected brightness. Therefore, delaying between starting time of obtaining the detected brightness by the light sensing component and starting time of the frame synchronization signal of a display component may be implemented. Accordingly, it is ensured that the light sensing component can detect the ambient brightness in the display time slot of the target pixel portion, the impact of the light emitted by the display array on ambient brightness detection of the light sensing component is reduced, and the accuracy of ambient brightness detection is improved.

In addition, implementing delaying between the starting time of obtaining the detected brightness by the light sensing component and the starting time of the frame synchronization signal of the display component based on the hardware circuit with the counting function is favorable for improving the delaying stability and ensuring the user experience.

In some embodiments, the method may further include that the frame synchronization signal generated by a display component of the mobile terminal is received through a delay portion. Fixed delay time of the delay portion may be predetermined according to the position relationship between the target pixel portion and the first pixel portion of the display array.

The delay portion may output a second triggering signal in a duration starting from reception of the frame synchronization signal to passing of the fixed delay time, and S100 may include that the detected brightness is obtained based on the second triggering signal through the light sensing component in the display time slot of the target pixel portion covered by the projection in the plane where the display array is located.

The delay portion may be a hardware circuit arranged outside the processing component of the electronic device. For example, the delay portion may include multiple series-wound delay flip-flops (D flip-flops).

In the embodiments of the present disclosure, delaying between the starting time of obtaining the detected brightness by the light sensing component and the starting time of the frame synchronization signal of the display component may be implemented based on the hardware circuit with a delay function, which is favorable for improving the delay stability and ensuring the user experience.

Figure 8:
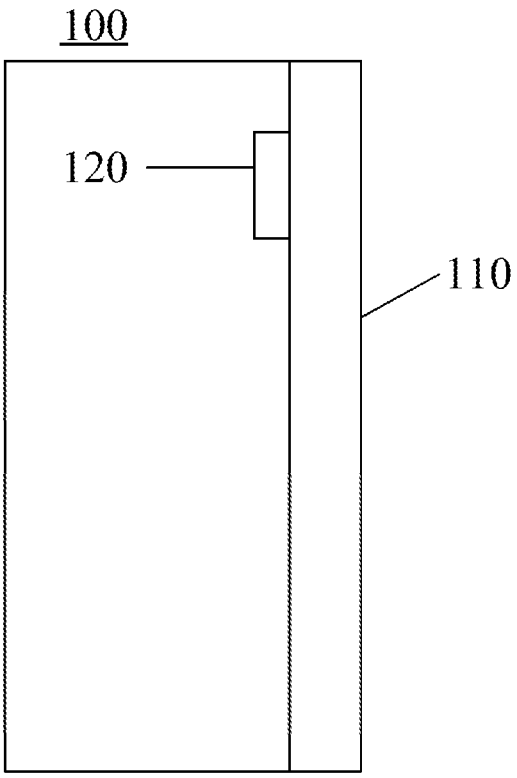
FIG. 8 is a block diagram of an electronic device according to an exemplary embodiment.

FIG. 8 is a block diagram of an electronic device 100 according to an exemplary embodiment. As shown in FIG. 8, the electronic device 100 includes a display component, including a display array 110, and a light sensing component 120, arranged on a back of the display array 110 and having a projection covering a target pixel portion in the display array 110 in a plane where the display array 110 is located.

The light sensing component 120 is configured to obtain detected brightness in a display time slot of the target pixel portion, and is further configured to determine a brightness scene according to present display brightness of the display array 110 and determine ambient brightness based on a calculation parameter, determined according to the brightness scene, a display refresh rate of the display array and the detected brightness, for calculation of the ambient brightness.

According to the embodiments of the present disclosure, the detected brightness may be obtained through the light sensing component in the display time slot of the target pixel portion covered by the projection in the plane where the display array is located, which reduces the impact of light emitted by the target pixel portion on the detected brightness obtained by the light sensing component and is favorable for improving the accuracy of the ambient brightness determined by the light sensing component.

In addition, according to the embodiments of the present disclosure, the brightness scene may be determined according to the present display brightness of the display array, the calculation parameter for calculation of the ambient brightness may be determined according to the brightness scene and the detected brightness, and the ambient brightness may be determined according to the calculation parameter. Corresponding calculation parameters may be automatically determined according to differences of brightness scenes of the display array to further determine the ambient brightness, which is favorable for further improving the accuracy of the determined ambient brightness.

Moreover, in the electronic device provided in the embodiment of the present disclosure, the display array or a display panel is not required to be perforated, so that the design complexity of the electronic device is reduced.

In some embodiments, the light sensing component 120 may include a first scene determination portion that is configured to, when the present display brightness of the display array 110 is greater than a brightness threshold, determine that the brightness scene is a high-light scene, or a first scene determination portion that is configured to, when a modulation manner for a driving signal corresponding to the present display brightness of the display array 110 is a DC modulation manner, determine that the brightness scene is the high-light scene.

In some embodiments, the light sensing component 120 may further include a second scene determination portion that is configured to, when the present display brightness of the display array 110 is less than or equal to the brightness threshold, determine that the brightness scene is a low-light scene, or a second scene determination portion that is configured to, when the modulation manner for the driving signal corresponding to the present display brightness of the display array 110 is a PAM or PWM manner, determine that the brightness scene is the low-light scene. It can be understood that the function of the first scene determination portion and the function of the second scene determination portion may be executed through the same preset scene determination portion.

In the embodiments of the present disclosure, the brightness scene may be determined by setting a brightness threshold and comparing present display brightness and the brightness threshold, or the brightness scene may be determined through a modulation manner for a driving signal corresponding to present display brightness. The manner is simple and highly compatible with the conventional art.

In some embodiments, the light sensing component 120 may include a calculation portion that is configured to, when the brightness scene is the high-light scene, estimate an value of impact of the present display brightness on ambient brightness determination of the light sensing component based on a preset model according to the detected brightness, the preset model being obtained by training detected brightness samples under a preset brightness scene, and the calculation portion can be further configured to determine the calculation parameter for calculation of the ambient brightness according to a difference value between the detected brightness and the value of impact.

In some embodiments, the calculation portion is further configured to, when the brightness scene is the low-light scene, determine the detected brightness as the calculation parameter for calculation of the ambient brightness.

In some embodiments, a detection frequency at which the light sensing component 120 obtains the detected brightness is higher than double of the display refresh rate of the display array 110.

Figure 9:
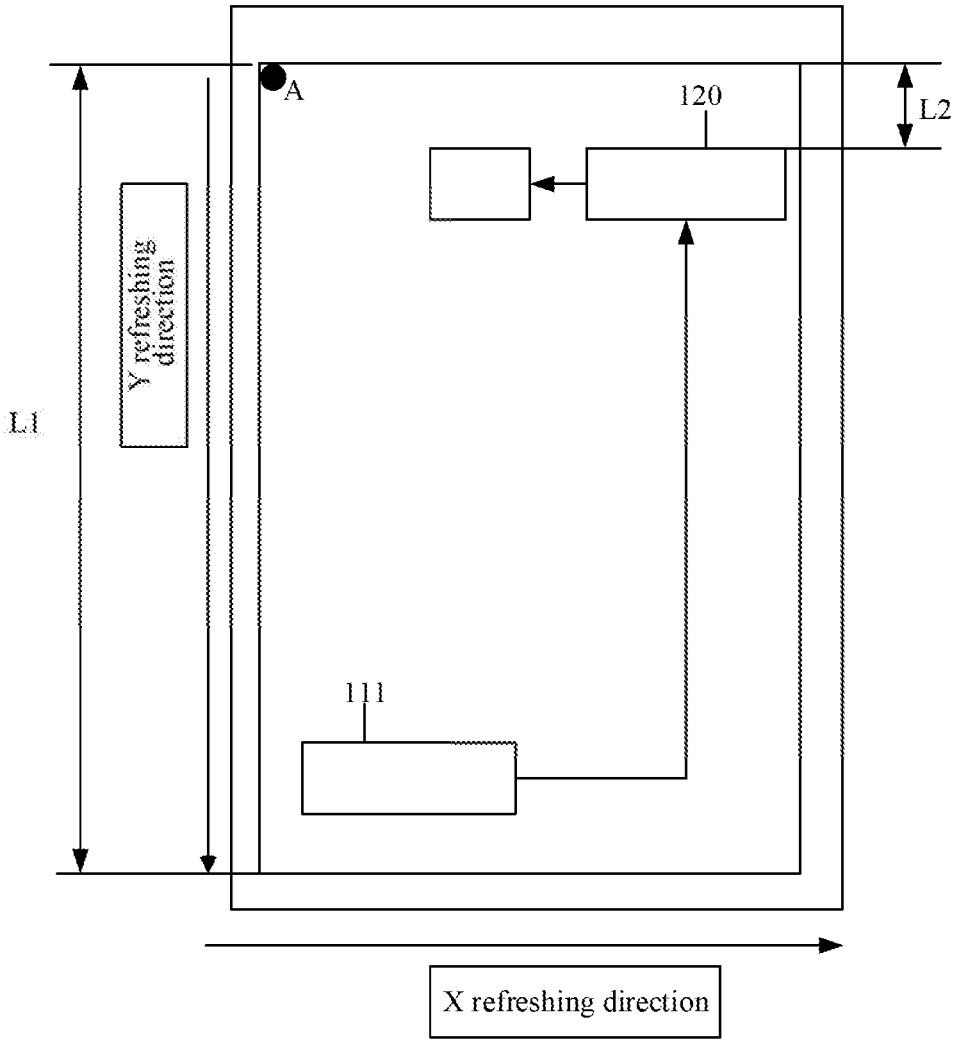
FIG. 9 is a partial schematic diagram of an electronic device according to an exemplary embodiment.

In some embodiments, referring to FIG. 9, the display component may further include a driving portion 111 that generates a frame synchronization signal. The frame synchronization signal may be for triggering the display refreshing of the display array 110.

The light sensing component 120 may include a time slot determination portion. The time slot determination portion may be electrically connected with the driving portion 111, and the time slot determination portion is configured to acquire delay time and determine the display time slot of the target pixel portion according to starting time of the frame synchronization signal and the delay time. The delay time may be predetermined according to a position relationship between the target pixel portion and a first pixel portion of the display array 110.

Exemplarily, before the display array 110 displays each frame of image, the driving portion 111 may generate a frame synchronization signal. The display array may start scanning pixel portions in the display array based on the frame synchronization signal, clear corresponding content, displayed in a previous frame of image, of the pixel portions and display the corresponding content of the pixel portions in a next frame of image, to implement display refreshing of the display array.

In an example, the time slot determination portion may determine the delay time between starting time of display refreshing of the target pixel portion and the starting time of the frame synchronization signal of the display array 110 according to a position where the light sensing component 120 is arranged. It can be understood that, starting from reception of a frame synchronization signal by the time slot determination portion, display refreshing of the target pixel portion may be started after the delay time. The target pixel portion subjected to display refreshing may temporally stop emitting light and enter the display time slot. After the display time slot passes, the target pixel portion may emit light again to display corresponding content of the target pixel portion in the next frame of image.

The time slot determination portion may include a timer circuit, and the timer circuit is configured for timing. Specifically, when the time slot determination portion receives the frame synchronization signal, the timer circuit of the time slot determination portion may be started for calculating time. The timer circuit may count up or count down.

In an example, the display array 110 may include an array formed by multiple rows of pixel portions or multiple columns of pixel portions that are arranged in parallel. The first pixel portion of the display array 110 may include the first pixel portion subjected to display refreshing during display refreshing of the display array.

Exemplarily, the position relationship between the target pixel portion and the first pixel portion of the display array 110 may include a vertical distance between a target row where the target pixel portion is located and a pixel row where the first pixel portion is located, or, a vertical distance between a target column where the target pixel portion is located and a pixel column where the first pixel portion is located.

Referring to FIG. 9, there is made such a hypothesis that point A in the display array is a scanning starting point for display refreshing of the display array 110, namely the point is a position where the first pixel portion of the display array 110 is located. The electronic device performs refreshing from top to bottom along a Y refreshing direction and from left to right along an X refreshing direction, as shown in FIG. 9. The refresh rate of the display array 110 of the electronic device 100 is expressed as F, and then refresh time of each frame of image is t=1/F.

When a length of the display array 110 in the Y direction is $L_1$ and a vertical distance between the light sensing component 120 on the back of the display array 110 and the pixel row where the point A is located is $L_2$, the vertical distance between the light sensing component 120 and the pixel row where the point A is located may be reflected by the number of pixel portion rows between the target row where the target pixel portion is located and the pixel row where the point A is located.

In an example, when a spacing between every two adjacent rows of pixel portions in the display array is d and there are S rows of pixel portions between the target row where the target pixel portion is located and the pixel row where the point A is located, then $L_2=(S+1)d$. Specifically, when the point A is in a first row and the target pixel portion is in a fourth row, there may be two rows of pixel portions between the target row where the target pixel portion is located and the row where the point A is located, and $L_2=3d$.

When the display array 110 starts refreshing row by row from the row where the point A is located along the Y-axis direction, after each frame synchronization signal is received, time required for delayed integration of the light sensing component 120 may be time required by a process from the start of refreshing at the point A to refreshing of the target pixel portion. Therefore, in a refresh process of each frame of image, time for integration of the light sensing component 120 is $t_1=(L_2/L_1)/F$. In time from $t_1$ to $t_2=t-t_1$, the light sensing component 120 may perform sampling to obtain the detected brightness at the detection frequency higher than double or more of the display refresh rate of the display array 110.

At a starting time point for display refreshing of a new frame of image, the driving portion 111 of the display array may directly send a hardware interrupt signal to the light sensing component 120. The light sensing component, after receiving the interrupt signal, may start a new round of accumulated timing till $t_1$. When the synchronization signal is directly sent to the light sensing component 120, the light sensing component 120 may start integral sampling after a delay $t_1$ through an internal phase-locked loop or counter.

According to the embodiments of the present disclosure, the frame synchronization signal may be directly sent to the light sensing component 120, the display time slot of the target pixel portion may be determined based on the time slot determination portion of the light sensing component 120, and the detected brightness may be obtained based on the structure of the light sensing component 120 after a delayed period of time after the frame synchronization signal is received. The manner is simple, and high compatibility with the conventional art is achieved.

Figure 10:
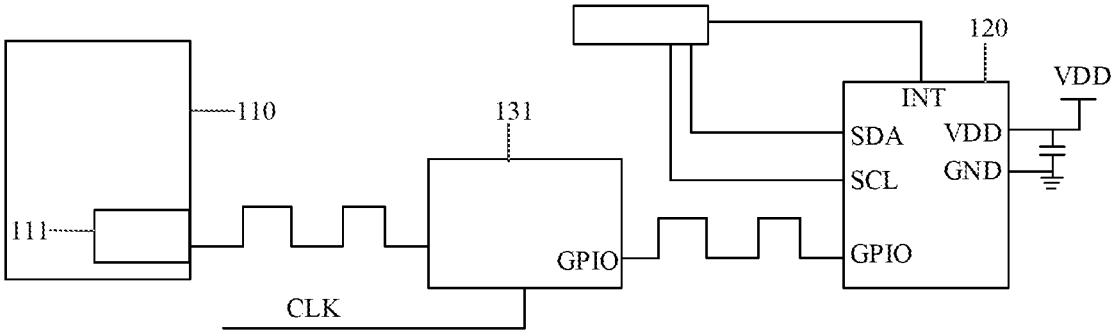
FIG. 10 is another partial schematic diagram of the electronic device according to an exemplary embodiment.

In some embodiments, referring to FIG. 10, the display component may further include the driving portion 111 that generates the frame synchronization signal. The frame synchronization signal may trigger display refreshing of the display array 110.

The electronic device 100 may further include a processing component 130, and the processing portion 130 may be electrically connected with the driving portion 111 and the light sensing component 120. The processing portion 130 is configured to acquire the delay time and determine the display time slot of the target pixel portion according to the starting time of the frame synchronization signal and the delay time. The delay time may be predetermined according to the position relationship between the target pixel portion and the first pixel portion of the display array 110.

Exemplarily, the processing component 130 may include a CPU, an AP or an MCU, and the like. The processing component 130 may determine the display time slot of the target pixel portion in a software manner. Or, the processing component 130 may further include a hardware circuit that determines the display time slot of the target pixel portion. In the embodiments of the present disclosure, multiple manners may be provided for determination of the display time slot of the target pixel portion, and flexibility in implementation is achieved.

After the electronic device 100 completes scanning a frame of image, the frame synchronization signal may be transmitted to the processing component 130 through the driving portion 111, and a next frame of image may be started to be scanned. The processing component 130 may transmit a wakeup signal to the light sensing component 120 through a serial clock line (SCL) pin and a serial data line (SDA) after the delay time after a moment when the frame synchronization signal is received. The light sensing component 120 may configure an internal circuit according to a wakeup signal to complete initialization of the light sensing component 120. The initialized light sensing component 120 may wait for a first control signal for starting ambient brightness detection. The light sensing component 120, when receiving a first control signal, may start obtaining the detected brightness.

Exemplarily, the electronic device 100 may include multiple light sensing components 120, and different light sensing components 120 may be distributed at different positions on the back of the display array 110. For example, when the display array 110 is rectangular and the electronic device 100 includes four light sensing components 120, the four light sensing components 120 may be arranged in each corner of the back of the rectangular display array 110 respectively. In such a case, the processing component 130 may enable at least one light sensing component 120 according to an actual requirement during ambient brightness detection.

Specifically, when left power of the electronic device 100 is greater than a low-power threshold or when the electronic device 100 is in a charged state, the processing component 130 may wake up the multiple light sensing components 120 at different positions, so that the accuracy of ambient brightness detection may be improved.

When the left power of the electronic device 100 is less than or equal to the low-power threshold, the processing component 130 may wake up one light sensing component 120, so that it is ensured that an ambient brightness detection function may normally work. On this premise, the power consumption of the electronic device 100 may be reduced and the standby time of the electronic device 100 may be prolonged. Herein, the low-power threshold may be 20%. That is, when present left battery power is less than or equal to 20% of total power, it may be considered that the left power of the electronic device is less than or equal to the low-power threshold.

After the processing component 130 determines the display time slot of the target pixel portion, the driving portion 111 may send a frame synchronization signal to a general purpose input/output (I/O) interface of the processing component 130. The processing component 130, after receiving the frame synchronization signal, may send the first control signal to the light sensing component 120 after the delay time to control the light sensing component 120 to start obtaining the detected brightness. In some embodiments, the delay time may have a predetermined number of delay time lengths.

The processing component 130 may include a delayer. The delayer is electrically connected with the driving portion 111, and the delayer is configured to count the number of delay time lengths and output a first triggering signal when counting is ended.

The light sensing component 120 is configured to obtain the detected brightness based on triggering of the first triggering signal.

In an example, when the frame synchronization signal generated by the driving portion reports that display refreshing of a frame of image is completed, the delayer in the processing component 13 may start counting according to the received frame synchronization signal. The delayer may count up or count down.

When the display array starts display refreshing row by row from the point A along the Y refreshing direction in FIG. 9 and the target pixel portion is in the display time slot when the delayer ends counting, the delayer may send the first triggering signal to the light sensing component 120 to trigger the light sensing component 120 to start obtaining the detected brightness.

In the embodiments of the present disclosure, the delayer may start counting the number of delay time lengths when the frame synchronization signal is received and trigger the light sensing component 120 to start obtaining the detected brightness when counting is ended, so that delaying between starting time of obtaining the detected brightness by the light sensing component 120 and starting time of the frame synchronization signal of the display component can be realized to ensure that the light sensing component 120 can detect the ambient brightness in the display time slot of the target pixel portion, the impact of brightness of light emitted by the target pixel portion on brightness detection of the light sensing component 120 is reduced, the difference value between the detected brightness obtained by the light sensing component 120 and actual ambient brightness is reduced, and the accuracy of ambient brightness detection is improved.

In addition, according to the embodiments of the present disclosure, delaying between the start of obtaining the detected brightness by the light sensing component 120 and the starting time of the frame synchronization signal of the display component may be realized based on a hardware circuit such as the delayer, the device can be high in working stability, and the stability of ambient brightness detection and the user experience can be ensured.

Figure 11:
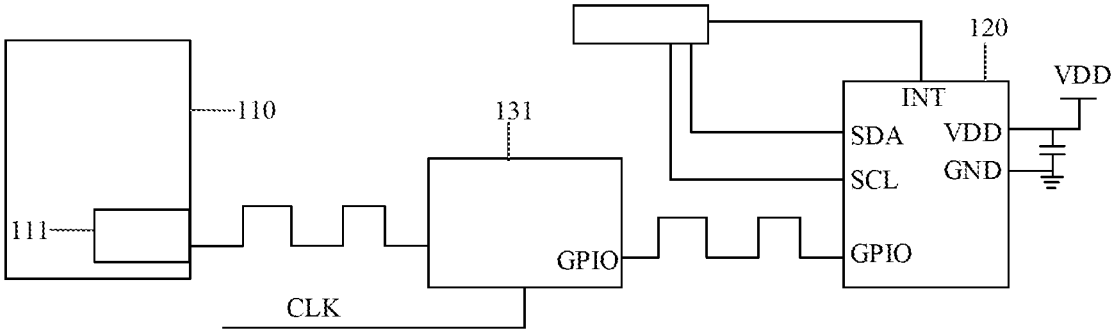
FIG. 11 is another partial schematic diagram of the electronic device according to an exemplary embodiment.

In some embodiments, referring to FIG. 11, the display component may further include a driving portion 111 that generates a frame synchronization signal. The frame synchronization signal may trigger display refreshing of the display array 110.

The electronic device 100 may further include a delay portion 131. The delay portion is electrically connected with the driving portion 111 and the light sensing component 120, and the delay portion 131 is configured to output a second triggering signal after fixed delay time after reception of the frame synchronization signal. The fixed delay time may be predetermined according to the position relationship between the target pixel portion and the first pixel portion of the display array.

The light sensing component 120 may be configured to obtain the detected brightness based on triggering of the second triggering signal.

Exemplarily, the delay portion 131 may be a hardware circuit with a delay function. For example, the delay portion 131 may include multiple series-wound D flip-flops.

In the embodiments of the present disclosure, delaying between the start of obtaining the detected brightness by the light sensing component 120 and the starting time of the frame synchronization signal of the display component can be realized based on a hardware circuit with a delay function, which is favorable for improving the delaying stability and ensuring the user experience.

Figure 12:
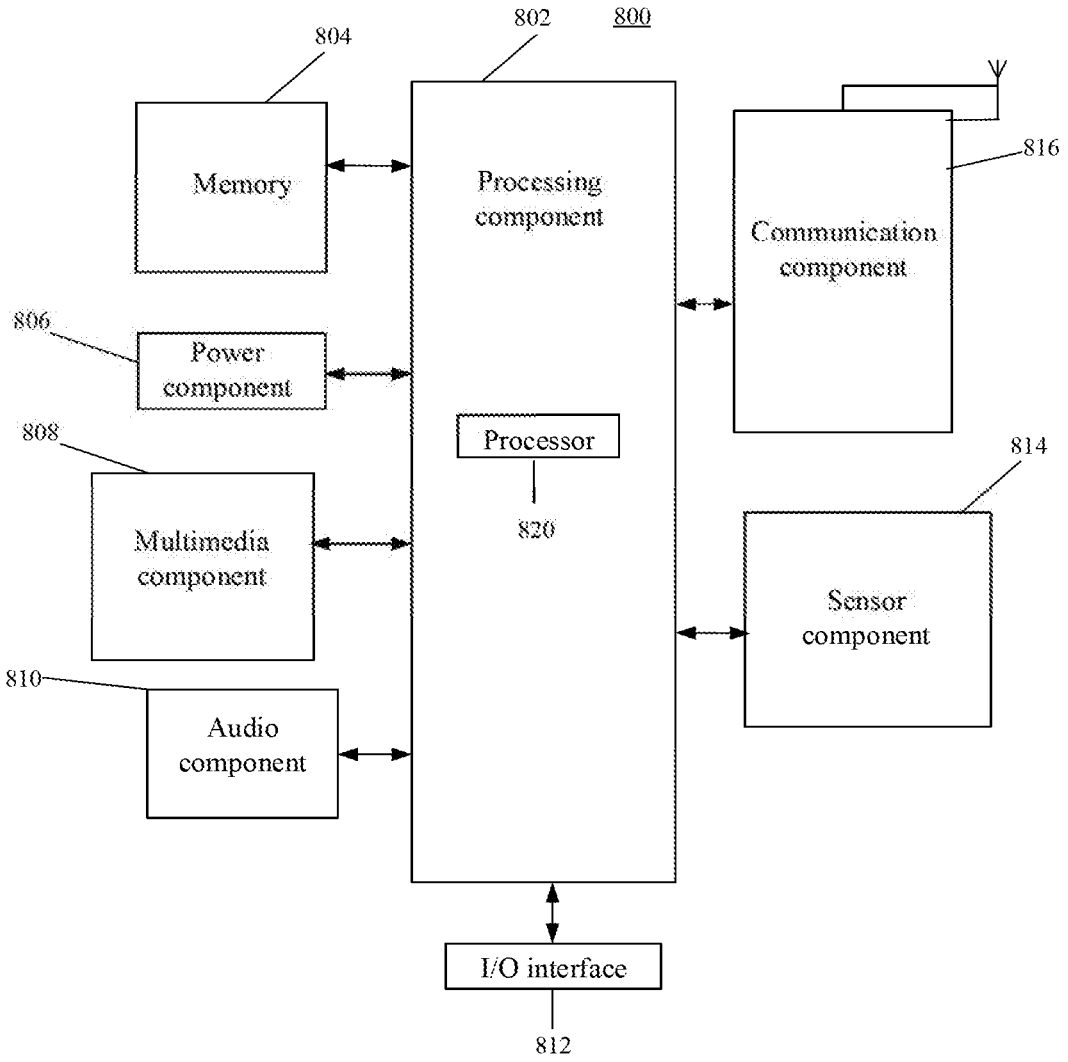
FIG. 12 is a block diagram of an apparatus for ambient brightness detection according to an exemplary embodiment.

FIG. 12 is a block diagram of an apparatus 800 for ambient brightness detection according to an exemplary embodiment. For example, the device 800 may be a mobile phone, a computer, a digital broadcast terminal, a messaging device, a gaming console, a tablet, a medical device, exercise equipment, a personal digital assistant, and the like.

Referring to FIG. 12, the apparatus 800 may include one or more of the following components: a processing component 802, a memory 804, a power component 806, a multimedia component 808, an audio component 810, an I/O interface 812, a sensor component 814, and a communication component 816.

The processing component 802 typically controls overall operations of the apparatus 800, such as the operations associated with display, telephone calls, data communications, camera operations, and recording operations. The processing component 802 may include one or more processors 820 to execute instructions to perform all or part of the operations in the abovementioned method. Moreover, the processing component 802 may further include one or more components which facilitate interaction between the processing component 802 and the other components. For instance, the processing component 802 may include a multimedia component to facilitate interaction between the multimedia component 808 and the processing component 802.

The memory 804 is configured to store various types of data to support the operation of the apparatus 800. Examples of such data include instructions for any applications or methods operated on the apparatus 800, contact data, phonebook data, messages, pictures, video, etc. The memory 804 may be implemented by any type of volatile or non-volatile memory devices, or a combination thereof, such as a Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, and a magnetic or optical disk.

The power component 806 may provide power for various components of the apparatus 800. The power component 806 may include a power management system, one or more power supplies, and other components associated with generation, management and distribution of power for the apparatus 800.

The multimedia component 808 may include a screen providing an output interface between the apparatus 800 and a user. In some embodiments, the screen may include a Liquid Crystal Display (LCD) and a Touch Panel (TP). If the screen includes the TP, the screen may be implemented as a touch screen to receive an input signal from the user. The TP includes one or more touch sensors to sense touches, swipes and gestures on the TP. The touch sensors may not only sense a boundary of a touch or swipe action but also detect a duration and pressure associated with the touch or swipe action. In some embodiments, the multimedia component 808 includes a front camera and/or a rear camera. The front camera and/or the rear camera may receive external multimedia data when the apparatus 800 is in an operation mode, such as a photographing mode or a video mode. Each of the front camera and/or the rear camera may be a fixed optical lens system or have focusing and optical zooming capabilities.

The audio component 810 is configured to output and/or input an audio signal. For example, the audio component 810 includes a Microphone (MIC), and the MIC is configured to receive an external audio signal when the apparatus 800 is in the operation mode, such as a call mode, a recording mode and a voice recognition mode. The received audio signal may further be stored in the memory 804 or sent through the communication component 816. In some embodiments, the audio component 810 further includes a speaker configured to output the audio signal.

The I/O interface 812 may provide an interface between the processing component 802 and a peripheral interface component, and the peripheral interface component may be a keyboard, a click wheel, a button and the like. The button may include, but not limited to: a home button, a volume button, a starting button and a locking button.

The sensor component 814 may include one or more sensors configured to provide status assessment in various aspects for the apparatus 800. For instance, the sensor component 814 may detect an on/off status of the apparatus 800 and relative positioning of components, such as a display and small keyboard of the apparatus 800, and the sensor component 814 may further detect a change in a position of the apparatus 800 or a component of the apparatus 800, presence or absence of contact between the user and the apparatus 800, orientation or acceleration/deceleration of the apparatus 800 and a change in temperature of the apparatus 800. The sensor component 814 may include a proximity sensor configured to detect presence of an object nearby without any physical contact. The sensor component 814 may also include a light sensor, such as a Complementary Metal Oxide Semiconductor (CMOS) or Charge Coupled Device (CCD) image sensor, configured for use in an imaging application. In some embodiments, the sensor component 814 may also include an acceleration sensor, a gyroscope sensor, a magnetic sensor, a pressure sensor or a temperature sensor.

The communication component 816 is configured to facilitate wired or wireless communication between the apparatus 800 and another apparatus. The apparatus 800 may access a communication-standard-based wireless network, such as a Wireless Fidelity (WiFi) network, a 2nd-Generation (2G) or 3rd-Generation (3G) network or a combination thereof. In an exemplary embodiment, the communication component 816 receives a broadcast signal or broadcast associated information from an external broadcast management system through a broadcast channel. In an exemplary embodiment, the communication component 816 further includes a Near Field Communication (NFC) component to facilitate short-range communication. For example, the NFC component may be implemented based on a Radio Frequency Identification (RFID) technology, an infrared Data Association (IrDA) technology, an Ultra-WideBand (UWB) technology, a Bluetooth (BT) technology or another technology.

In an exemplary embodiment, the apparatus 800 may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components, and is configured to execute the abovementioned method.

In an exemplary embodiment, there is also provided a non-transitory computer-readable storage medium including instructions, such as the memory 804 including instructions, and the instructions may be executed by the processor 820 of the apparatus 800 to implement the abovementioned method. For example, the non-transitory computer-readable storage medium may be a ROM, a Random Access Memory (RAM), a Compact Disc Read-Only Memory (CD-ROM), a magnetic tape, a floppy disc, an optical data storage device, and the like.

According to a non-transitory computer-readable storage medium, instructions in the storage medium may be executed by a processor of a mobile terminal to cause the mobile terminal to implement the operations in the ambient brightness detection method provided in the embodiments of the present disclosure.

Other implementation solutions of the present disclosure will be apparent to those skilled in the art from consideration of the specification and practice of the present disclosure. This present disclosure is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the appended claims.

It will be appreciated that the present disclosure is not limited to the exact construction that has been described above and illustrated in the accompanying drawings, and that various modifications and changes may be made without departing from the scope thereof. It is intended that the scope of the present disclosure only be limited by the appended claims.

What is claimed is:

1. A method for ambient brightness detection that is implemented by an electronic device including a display array and a light sensing component that is arranged on a back side of the display array, the method comprising:

obtaining a detected brightness through the light sensing component in a display time slot of a target pixel portion covered by a projection in a plane where the display array is located;

determining a brightness scene according to a present display brightness of the display array;

determining a calculation parameter for calculation of an ambient brightness according to the brightness scene, a display refresh rate of the display array, and the detected brightness; and determining the ambient brightness based on the calculation parameter.

2. The method of claim 1, wherein determining the calculation parameter for calculation of the ambient brightness according to the brightness scene and the detected brightness further comprises:

estimating a value of impact of the present display brightness on the ambient brightness determination of the light sensing component based on a preset model according to the detected brightness when the brightness scene is a high-light scene, wherein the preset model is obtained by training detected brightness samples under a preset brightness scene; and determining the calculation parameter for calculation of the ambient brightness according to a difference value between the detected brightness and a value of impact.

3. The method of claim 2, wherein determining the brightness scene according to the present display brightness of the display array further comprises:

determining that the brightness scene is the high-light scene when the present display brightness is greater than a brightness threshold; or determining that the brightness scene is the high-light scene when a modulation manner for a driving signal corresponding to the present display brightness is a direct current (DC) modulation manner.

4. The method of claim 2, wherein determining the calculation parameter for calculation of the ambient brightness according to the brightness scene and the detected brightness further comprises:

determining the detected brightness as the calculation parameter for calculation of the ambient brightness when the brightness scene is a low-light scene.

5. The method of claim 4, wherein determining the brightness scene according to the present display brightness of the display array further comprises:

determining that the brightness scene is the low-light scene when the present display brightness is less than or equal to the brightness threshold; or determining that the brightness scene is the low-light scene when a modulation manner for a driving signal corresponding to the present display brightness is a pulse amplitude modulation (PAM) manner or a pulse width modulation (PWM) manner.

6. The method of claim 1, wherein a detection frequency at which the light sensing component obtains the detected brightness is higher than double of the display refresh rate.

7. The method of claim 1, further comprising:

determining a display time slot of the target pixel portion according to a frame synchronization signal of the display array and an acquired delay time, wherein the delay time is predetermined according to a position relationship between the target pixel portion and a first pixel portion of the display array.

8. The method of claim 1, wherein determining the ambient brightness based on the calculation parameter further comprises:

determining the ambient brightness according to the calculation parameter and an attenuation/gain coefficient.

9. An electronic device, comprising:

a display component having a display array; and a light sensing component that is arranged on a back side of the display army, wherein the light sensing component has a projection covering a target pixel portion in the display array in a plane where the display array is located, and the light sensing component is configured to obtain detected brightness in a display time slot of the target pixel portion and further configured to determine a brightness scene according to present display brightness of the display array and determine ambient brightness based on a calculation parameter that is determined according to the brightness scene, a display refresh rate of the display array, and the detected brightness, for calculation of the ambient brightness.

10. The electronic device of claim 9, wherein the light sensing component further comprises a calculation portion that is configured to:

estimate a value of impact of the present display brightness on an ambient brightness determination of the light sensing component based on a preset model according to the detected brightness when the brightness scene is a high-light scene, the preset model being obtained by training detected brightness samples under a preset brightness scene, and determine the calculation parameter for calculation of the ambient brightness according to a difference value between the detected brightness and a value of impact.

11. The electronic device of claim 10, wherein the light sensing component further comprises:

a first scene determination portion that is configured to determine that the brightness scene is the high-light scene when the present display brightness of the display array is greater than a brightness threshold; or the first scene determination portion that is configured to determine that the brightness scene is the high-light scene when a modulation manner for a driving signal corresponding to the present display brightness of the display array is a direct current (DC) modulation manner.

12. The electronic device of claim 10, wherein the calculation portion is further configured to determine the detected brightness as the calculation parameter for calculation of the ambient brightness when the brightness scene is a low-light scene.

13. The electronic device of claim 12, wherein the light sensing component further comprises:

a second scene determination portion that is configured to determine that the brightness scene is the low-light scene when the present display brightness of the display array is less than or equal to the brightness threshold; or the second scene determination portion that is configured to determine that the brightness scene is the low-light scene when a modulation manner for a driving signal corresponding to the present display brightness of the display array is a pulse amplitude modulation (PAM) or pulse width modulation (PWM) manner.

14. The electronic device of claim 9, wherein a detection frequency at which the light sensing component obtains the detected brightness is higher than double of the display refresh rate.

15. The electronic device of claim 9, wherein:

the display component further comprises a driving portion that generates a frame synchronization signal that triggers display refreshing of the display array, and the light sensing component comprises a time slot determination portion that is electrically connected with the driving portion and is configured to acquire delay time and determine the display time slot of the target pixel portion according to a starting time of the frame synchronization signal and the delay time, the delay time being predetermined according to a position relationship between the target pixel portion and a first pixel portion of the display array.

16. An apparatus for ambient brightness detection that is implemented by an electronic device including a display array and a light sensing component that is arranged on a back side of the display array, the apparatus comprising:

a processor; and a memory that is configured to store instructions executable by the processor, wherein the processor is configured to:

obtain a detected brightness through the light sensing component in a display time slot of a target pixel portion covered by a projection in a plane where the display array is located;

determine a brightness scene according to present display brightness of the display array;

determine a calculation parameter for calculation of ambient brightness according to the brightness scene, a display refresh rate of the display array, and the detected brightness; and determine the ambient brightness based on the calculation parameter.

17. The apparatus of claim 16, wherein the processor is further configured to:

estimate a value of impact of the present display brightness on an ambient brightness determination of the light sensing component based on a preset model according to the detected brightness when the brightness scene is a high-light scene, wherein the preset model is obtained by training detected brightness samples under a preset brightness scene; and determine the calculation parameter for calculation of the ambient brightness according to a difference value between the detected brightness and a value of impact.

18. The apparatus of claim 17, wherein the processor is further configured to:

determine that the brightness scene is the high-light scene when the present display brightness is greater than a brightness threshold; or, determine that the brightness scene is the high-light scene when a modulation manner for a driving signal corresponding to the present display brightness is a direct current (DC) modulation manner.

19. The apparatus of claim 17, wherein the processor is further configured to:

determine the detected brightness as the calculation parameter for calculation of the ambient brightness when the brightness scene is a low-light scene.

20. A non-transitory computer-readable storage medium, having instructions stored thereon that, when executed by a processor of a mobile terminal, cause the mobile terminal to execute the method of claim 1.

* * * * *